US005800280A

United States Patent [19]

Rogers

[11] Patent Number: 5,800,280

[45] Date of Patent: Sep. 1, 1998

[54] GOLF BALL RETRIEVER

[76] Inventor: Gordon Rogers, 23 Winwood, School La., Woolton, Liverpool L25 7XJ, United Kingdom

[21] Appl. No.: 757,000

[22] Filed: Nov. 26, 1996

[51] Int. Cl.[6] ..... A63B 57/00

[52] U.S. Cl. ..... 473/286; 294/19.2

[58] Field of Search ..... 473/282, 283, 473/284, 285, 286; 294/19.2

[56] References Cited

U.S. PATENT DOCUMENTS 3,997,169 12/1976 Bergstrom ..... 473/286

5,460,366 10/1995 Pugh ..... 473/286

*Primary Examiner*—Sebastiano Passaniti

*Assistant Examiner*—Stephen L. Blau

*Attorney, Agent, or Firm*—Howell & Haferkamp, L.C.

[57] ABSTRACT

A golf ball retriever that is integrally formed from a single sheet of a resilient flexible material comprises two panels separated by an H-shaped strap. The H-shaped strap is connected to end edges of the two panels along fold lines, and folds up in between the two panels as the two panels are brought together with their side and end edges aligned. The side edges of one panel are releasably interlocked with the side edges of the other panel by engaging respective tabs and slots provided along the panel side edges. When a force is applied to the interlocked side edges, the panels bow outwardly to form a tube having open tube ends. The golf ball retriever can be attached to the handle of a golf club by inserting the handle into one of the open tube ends, and then removing the force applied to the side edges. The H-shaped strap prevents the handle from extending into the tube beyond a predetermined distance. With the ball retriever attached to the handle, a golf ball can be retrieved with the other open tube end which grasps the golf ball with a biting action due to the resiliency of the flexible panels.

18 Claims, 2 Drawing Sheets

GOLF BALL RETRIEVER

BACKGROUND OF THE INVENTION (1) Field of the Invention

The present invention relates to a ball retriever for retrieving a ball when temporarily attached to an extension member. More particularly, the present invention relates to a golf ball retriever for retrieving a golf ball when temporarily attached to the handle of a golf club, where the golf ball retriever is integrally formed from a single sheet of a resilient, flexible material (2) Description of the Related Art The inventor hereof previously designed and developed a golf ball retriever that allows an individual to retrieve a golf ball from the ground without bending at the waist when the golf ball retriever is temporarily attached to the handle of a golf club. As disclosed in U.S. Pat. No. 5,190,288, the disclosure of which is incorporated herein by reference, and as shown in FIGS. 1A–1D herein, the inventor's original golf ball retriever comprises two identical plates a, b that are attached to one another along their side edges. By applying a force to the attached side edges, the plates bow outwardly to form a tube having open ends. The ball retriever can be temporarily attached to the handle of a conventional golf club by inserting the handle into one of the tube ends and then releasing the force applied to the attached side edges. Two crisscrossing plastic strips c, d are provided in the tube interior to prevent the club handle from extending into the tube by more than approximately one half of the tube's length. With the ball retriever attached to the club handle, a golf ball can be retrieved with the other open end of the tube. To do this, the user applies a force to the golf club shaft, thereby forcing the golf ball into the other open end of the golf ball retriever.

Although the inventor's original golf ball retriever remains commercially valuable, and represented a significant advance in the art of ball retrievers at the time of its development, it is nevertheless disadvantaged in several significant respects. Most notably, producing the original golf ball retriever requires too many manufacturing steps, thereby contributing to an undesirably high manufacturing cost. The manufacturing process includes cutting four different parts—the two outer plates a, b and the two center strips c, d—from one or more sheets of a resilient material. Both ends of each center strip must then be stapled to one of the outer plates, followed by stapling the center strips together at their midsections. Next, a length of tape e must be applied over the outer surface and side edges of the first plate a so as to overlap the side edges of the second plate b. Finally, a second length of tape f is applied over the outer surface and side edges of the second plate b so as to overlap the side edges of the first plate a as well as portions of the first length of adhesive tape e already attached thereto. Thus, numerous steps are required to produce and assemble the inventor's original golf ball retriever.

Furthermore, the use of staples g in the inventor's original golf ball retriever can cause the ball retriever to crack or otherwise fail when subjected to repeated use. The staples g that are used to attach the center strips c, d to each other and to the outer plates a, b can cause the center strips to crack or break immediately adjacent to the staples. The tendency of the center strips to crack and fail is also attributable to the fact that the center strips form a stop surface for the golf club handle along their end edges, rather than across their length or width where forces can be more evenly distributed. As a result of cracking, the stop surface formed by the stapled center strips, which is critical to the device's operation, can become impaired or destroyed. The staples can also cause the outer plates to split or splinter, again impairing or destroying the operability of the device, where such splintering typically originates proximate to where the staples pass through the outer plates. Of course, any initial splitting in the component parts of the device is compounded by the flexible manner in which the device operates. Once fractures occur, any remaining usefulness of the device will be short-lived.

What is needed is a golf ball retriever that maintains many of the desirable attributes of the inventor's original ball retriever, while having a significantly lower manufacturing cost and a substantially longer usable life span. Such a golf ball retriever is preferably constructed without materials such as staples which can induce mechanical failures, while being constructed from a minimum number of parts and materials and with a minimum number of steps so as to decrease the time required to produce and assemble the ball retriever, thereby decreasing manufacturing costs. The golf ball retriever should also have the ability to lie flat for compact storage when not in use, and should be adapted to fit any conventional golf club handle.

SUMMARY OF THE INVENTION

The inventor hereof has succeeded at solving these and other needs in the art by designing and developing a new golf ball retriever that requires a significantly less number of parts and manufacturing steps than did the earlier device, thereby contributing to a reduced cost for the device, while more reliably performing its intended function without cracking. In the preferred embodiment, the golf ball retriever is formed integrally from a resilient flexible material such as plastic. Thus, the preferred golf ball retriever has a one-piece construction that can be conveniently folded into a working device. This is to be contrasted with the four plastic parts, two pieces of tape, and five staples required to construct the original golf ball retriever. As a result, many of the manufacturing steps associated with the earlier design have been eliminated. Moreover, by producing the golf ball retriever of the present invention solely from a flexible material and without the use of staples, for example, the problem of cracking experienced in the earlier design is likewise avoided.

The golf ball retriever of the preferred embodiment includes two substantially identical panels separated by an H-shaped strap. The H-shaped strap is attached to end edges of each of the two panels along fold lines, and can fold up in between the two panels as the side and end edges of the two panels are aligned. Hinged flaps are provided on the side and end edges of one of the panels and include tabs extending therefrom, while slots are provided along the side edges of the other panel. The side edges of the two panels can be releasably interlocked by folding the hinged flaps of the one panel around the side edges of the other panel and then engaging the tabs with the slots from an exterior side of the golf ball retriever.

By applying a force to the attached side edges of the two panels, the panels bow outwardly to form a tube having open tube ends, much like the inventor's original design. One of tube ends is sized for receiving the handle of a conventionally sized golf club, while the other tube end is sized for releasably grasping a golf ball with a resilient biting action. The H-shaped strap positioned between the two panels acts as a sling or cradle, and includes an intermediate section for engaging the end of the club handle to prevent the handle from extending into the tube more than a predetermined distance. The intermediate section engages the end of the club handle across its length and width, rather than along its side edges, to evenly distribute forces across its length and width to thereby reduce fatigue failures.

The inventor considers every aspect of the new golf ball retriever to be proprietary and protectable, including not only the device itself, but also the methods for producing and using the new golf ball retriever. While the principal advantages and features of the invention have been described above, a greater understanding of the invention may be attained by referring to the drawings and the description of the preferred embodiment which follow.

DETAILED DESCRIPTION OF THE PREFERRED EMBODIMENT

Figure 1A:
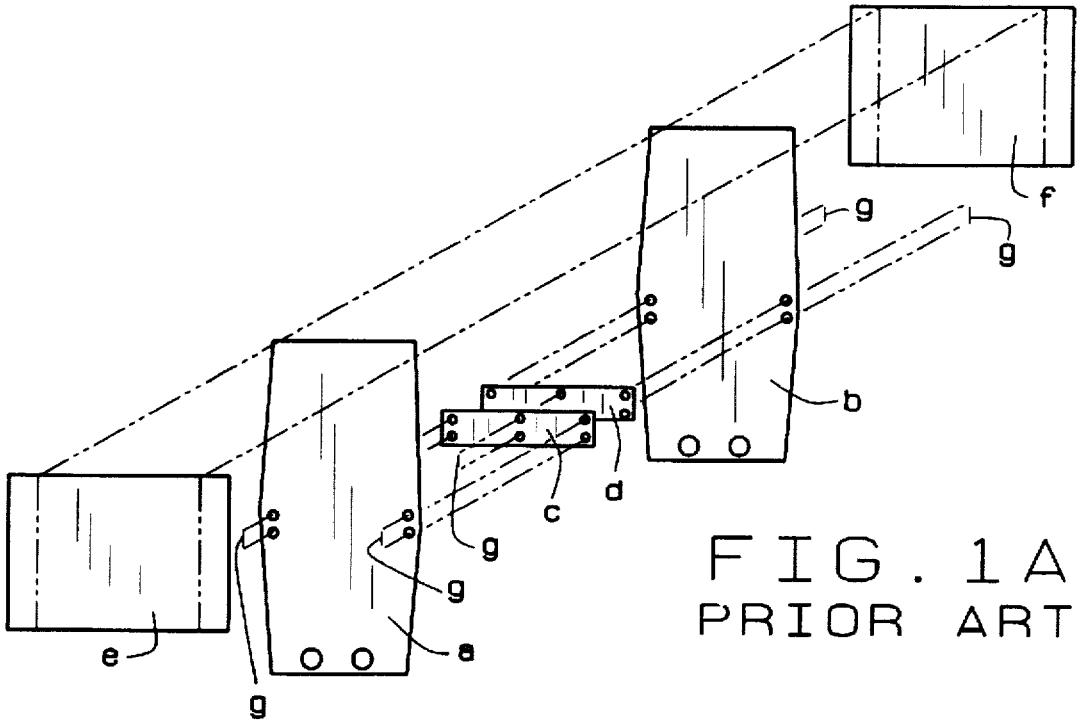
FIG. 1A PRIOR ART
FIGS. 1A–1D illustrate a prior art golf ball retriever.
Figure 1B:
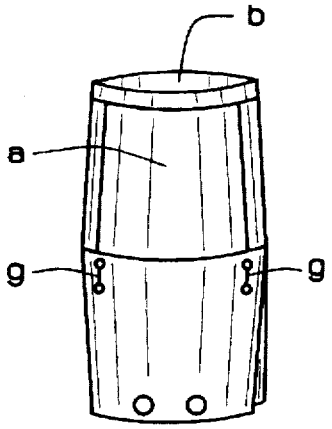
FIG. 1B PRIOR ART
Figure 1C:
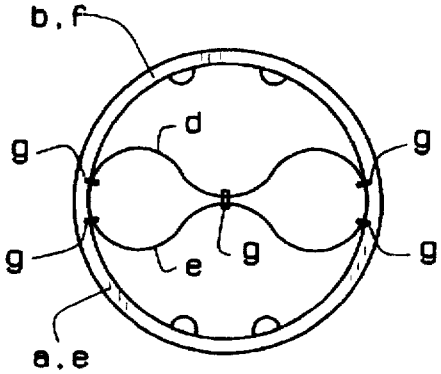
FIG. 1C PRIOR ART
Figure 1D:
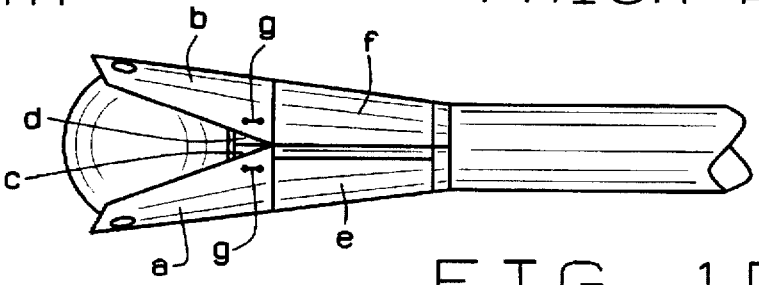
FIG. 1D PRIOR ART
Figure 2:
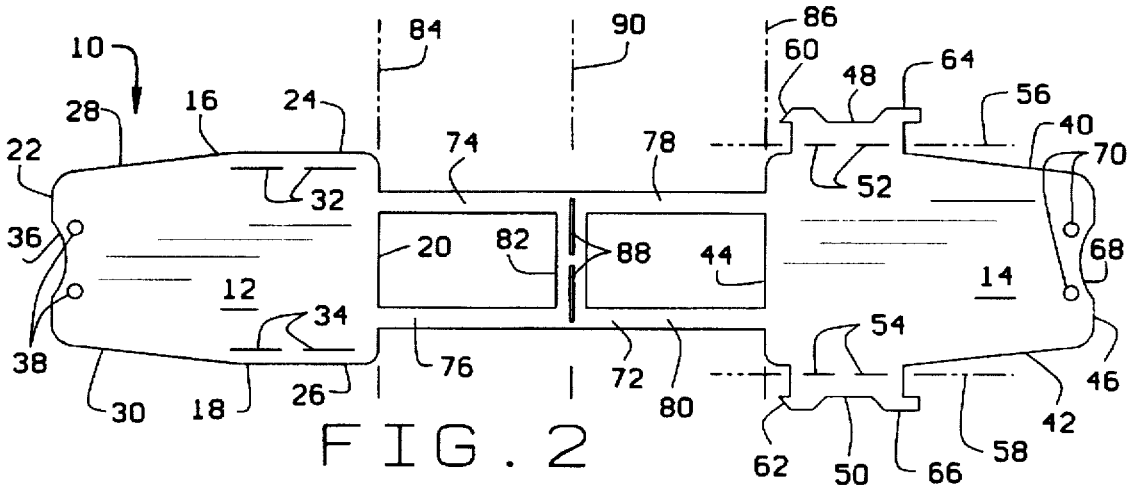
FIG. 2 is a top view of the golf ball retriever of the present invention shown "on the flat"

A preferred embodiment of a golf ball retriever in accordance with the present invention is shown "on the flat" in FIG. 2, designated generally by the reference character 10. The retriever 10 is preferably formed from a single sheet of a resilient flexible material, such as plastic, and includes opposite panels 12, 14. Panel 12 includes spaced opposite side edges 16, 18 and spaced opposite end edges 20, 22. Side edges 16, 18 include upper side portions 24, 26, respectively, where the side edges are generally straight and parallel with one another, and lower side portions 28, 30, respectively, where the side edges taper inwardly as they approach the end edge 22. Pairs of slots 32, 34 are formed in the panel 12 adjacent to the upper side portions 24, 26, respectively. The end edge 22 includes an arcuate portion 36, and the panel 12 includes a pair of bumps 38 positioned thereon adjacent to the arcuate portion 36.

The panel 14 includes spaced lower side portions 40, 42, spaced opposite end edges 44, 46, and hinged flaps 48, 50. The hinged flaps 48, 50 are provided at positions corresponding to the upper side portions 24, 26 of the panel 12, while the lower side portions 40, 42 of the panel 14 taper inwardly as they approach the end edge 46. Pairs of slots 52, 54 are formed in the hinged flaps 48, 50, respectively, slightly outwardly from where upper side portions would extend in parallel (like the upper side portions 24, 26 of the panel 12) if the hinged flaps 48, 50 were omitted.

Figure 4:
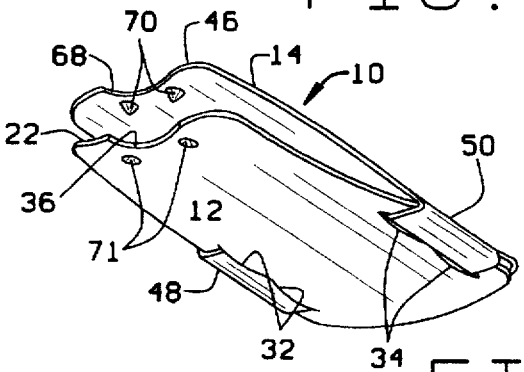
FIG. 4 is an isometric view illustrating the manner in which the side edges of the two outer panels are attached.

The pairs of slots 52, 54 define fold lines 56, 58, respectively, about which hinged flaps 48, 50 can pivot with respect to the panel 14. Each of the hinged flaps 48, 50 includes a tapered tab 60, 62, respectively, and a squared tab 64, 66, respectively, for engaging one of the pairs of slots 32, 34 formed in the panel 12. The end edge 46 includes an arcuate portion 68, and the panel 14 includes a pair of bumps 70 positioned thereon adjacent to the arcuate portion 68. As best shown in FIG. 4, the panel 12 has a pair of dimples 71 formed on its exterior side adjacent to the arcuate portion 36 of the end edge 22. The pair of dimples 71 correspond to the pair of bumps 38 formed on the opposite, interior side of the panel 12. Although not shown, the panel 14 includes a pair of dimples on its exterior side that correspond to the pair of bumps 70 formed on its interior side adjacent to the arcuate portion 68 of its end edge 46, as shown in FIG. 2.

An H-shaped cradle strap 72 extends between and joins the panels 12, 14 as shown in FIG. 2. The cradle strap includes stringers 74, 76, 78, 80 and an intermediate section 82 connected to one end of each of the stringers. The other ends of the stringers 74, 76 are connected to the panel 12 along a fold line 84, which is coextensive with end edge 20, while the other ends of the stringers 78, 80 are connected to the panel 14 along a fold line 86, which is coextensive with the end edge 44. The intermediate section 82 of the cradle strap 72 has a pair of slots 88 provided therein to form a fold line 90 about which the stringers 74, 76 can pivot with respect to the stringers 78, 80. As apparent to those skilled in the art, any of the fold lines can be scored as needed to facilitate folding.

Figure 3:
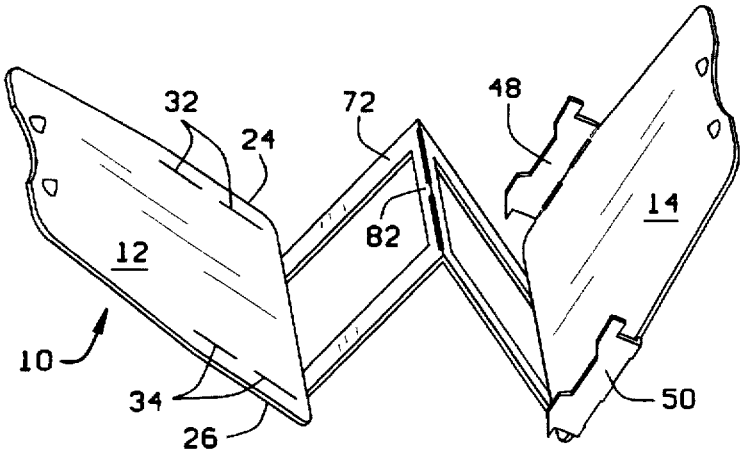
FIG. 3 is an isometric view illustrating the folding capability of the ball retriever shown in FIG. 2.

The golf ball retriever 10 of the preferred embodiment is easily manipulated into its operable position by folding the cradle strap 72 in between the panels 12, 14 as shown in FIG. 3, and then engaging the hinged flaps 48, 50 of the panel 14 with the pairs of slots 32, 34 in the panel 12, respectively, as shown in FIG. 4. The hinged flaps 48, 50 extend around the upper side portions 24, 26 of the panel 12 before engaging the pairs of slots 32, 34 from the exterior side of the panel 12. Thus, the golf ball retriever of the preferred embodiment can be quickly and easily assembled by folding the two panels into alignment and then attaching their respective side edges.

To engage, for example, the hinged flap 50 with the pair of slots 34, the squared tab 66 is first inserted in the lower of the pair of slots 34, i.e., the slot furthest away from the end edge 20. The tapered tab 62 can then be inserted in the upper slot of the pair of slots 34, i.e., the slot closest to the end edge 20. Although the size of the tapered tab 62 is slightly greater than the size of the upper slot which it engages, the tapered tab 62, like all other portions of the golf ball retriever of the preferred embodiment, is made from a flexible resilient material. Thus, the tapered tab 62 will flex as needed to permit its insertion through the upper slot, and will then return to its original shape shown in FIG. 2, due to its resiliency, so as to lock the hinged flap 50 into the pair of slots 34 as can be appreciated by those skilled in the art. Similarly, when a suitable extraction force is later applied to the hinged flap 50, the tapered tab 62 will flex as needed to permit its removal from the upper slot. The panel 14 can then be shifted with respect to the panel 12 to facilitate removal of the squared tab from the lower slot. It should be understood that the hinged flap 48 engages the pair of slots 32 in the same manner as that immediately described above for the hinged flap 50 and the pair of slots 34.

Figure 7:
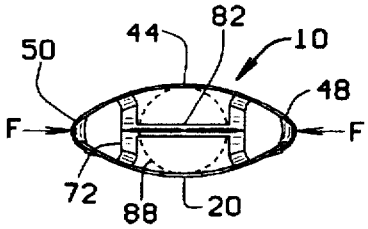
FIG. 7 is a side view of the golf ball retriever attached to a golf club handle and releasably grasping a golf ball.
Figure 5:
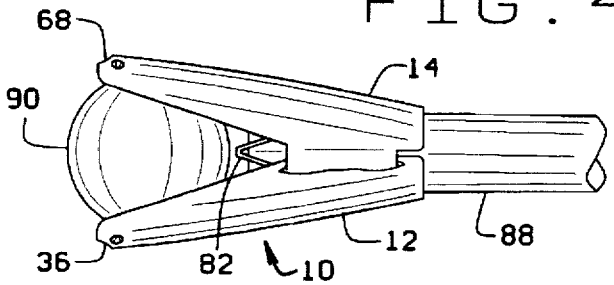
FIG. 5 is a top view of the golf ball retriever attached to a golf club handle shown in phantom.

Once the ball retriever has been assembled into the configuration shown in FIG. 4, it can be easily attached to the handle of a golf club by applying a force to the folded portions of the hinged flaps 48, 50, i.e., portions of the hinged flaps which lie along the fold lines 56, 58. This is illustrated in FIG. 5, where a force F is applied to the hinged flaps 48, 50 causing the ball retriever 10 to move from its generally flat position shown in FIG. 4 towards the bowed position shown in FIG. 5. Once a force is applied to sufficiently separate the end edges 20, 44 of the panels 12, 14, thereby forming a tube, the handle 88 of a golf club can be inserted into the tube. The force F can then be removed, at which time the panels 12, 14 will move back towards their generally flat positions, due to their resiliency, until they contact and grasp the club handle 88 as shown in FIG. 5. In this manner, the golf ball retriever can accommodate club handles of varying diameters. The club handle 88 is shown in phantom in FIG. 5 to permit illustration of the cradle strap 72, which acts as a sling for receiving and holding the club handle 88 within the tube. Specifically, the intermediate section 82 acts as a stop surface and prevents the club handle 88 from extending into the tube more than approximately one-half of the tube's length, while the stringers 74, 76, 78, 80 suspend and support the intermediate section 82 from the end edges 20, 44. FIGS. 5 and 7 also illustrate how the intermediate section 82 supports the club handle 88 across its length and width, rather than along its side edges, so as to distribute forces over a greater area.

Figure 6:
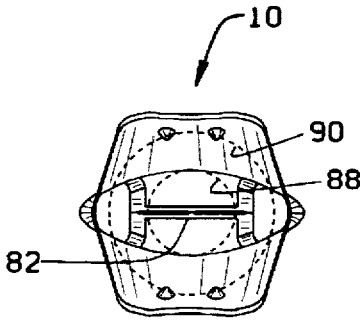
FIG. 6 is a bottom view of the golf ball retriever releasably grasping a golf ball shown in phantom.

As shown in FIGS. 6 and 7, with the ball retriever 10 attached to the club handle 88, a user of the device can conveniently retrieve a golf ball 90 from the ground with minimal bending at the waist or back. To accomplish this, the end edges 22, 46 of the panels are first placed in contact with the golf ball 90. The arcuate portions 36, 68 serve to center the golf ball and will allow the golf ball to force apart the panels 12, 14. As a firm force is applied by the user to the club handle, the end edges of the panel are forced further apart by the golf ball, thereby creating a counterforce biasing the panels 12, 14 towards their generally flat positions. This counterforce serves to hold the golf ball within the retriever. In this manner, the biased panels 12, 14 can spread apart like jaws for resiliently biting a golf ball to be retrieved. The pairs of bumps also facilitate retention of the ball by the resiliently biased panels 12, 14. Once the ball has been retained within the retriever, the user of the device can return the golf club to its normally upright position, and can easily remove the golf ball from the retriever 10.

As stated above, the golf ball retriever of the preferred embodiment is preferably constructed solely from a resilient flexible material so that materials that can induce fractures and mechanical failures in the device, such as staples, are avoided. This also simplifies the manufacture of the device and reduces costs, as only one type of material must be stocked and handled to construct the golf ball retriever. In addition, the golf ball retriever preferably has an integral or monolithic construction, i.e., a one-piece construction, so as to further simplify its construction and assembly. The golf ball retriever can be cut or stamped from a single sheet of a plastic, for example, or can be produced through molding. There are various changes and modifications which may be made to the invention as will be apparent to those skilled in the art. For example, the size of the ball retriever can be adjusted to accommodate retrieval of balls other than golf balls. However, these changes or modifications are included in the teaching of the disclosure, and it is intended that the invention be limited only by the scope of the claims appended hereto, and their equivalents.

What is claimed is:

1. A device for retrieving a golf ball when temporarily attached to a golf club handle, the device having a monolithic construction and comprising opposite panels formed of a generally flexible material, each of the opposite panels having first and second side edges, the first and second side edges of one of the opposite panels being attached to the first and second side edges of the other of the opposite panels, respectively, the opposites panels lying generally flat when no force is applied to the attached side edges and bowing outwardly between the attached side edges when a force is applied to the attached side edges to form a tube having opposite first and second tube openings, the first tube opening being sized to permit the insertion therethrough of the golf club handle and the second tube opening being sized to grasp the golf ball.

2. The device of claim 1 wherein the first side edge of the one opposite panel is releasably attached to the first side edge of the other opposite panel.

3. The device of claim 2 wherein the second side edge of the one opposite panel is releasably attached to the second side edge of the other opposite panel.

4. The device of claim 3 further comprising a strap extending between and connecting the opposite panels.

5. The device of claim 4 wherein the strap forms a cradle positioned between the opposite panels for preventing the golf club handle from extending more than a predetermined distance into the tube formed when the force is applied to the attached side edges.

6. The device of claim 2 wherein the one opposite panel includes a hinged flap extending from its first side edge, the other opposite panel includes a slot formed therein adjacent to its first side edge, and the hinged flap of the one opposite panel releasably engages the slot of the other opposite panel to releasably attach the first side edges of the opposite panels.

7. The device of claim 6 wherein the device includes interior and exterior sides, and the hinged flap of the one opposite panel extends around the first side edge of the other opposite panel and releasably engages the slot formed therein from the exterior side of the device.

8. The device of claim 1 wherein the device includes interior and exterior sides, the opposite panels each include two bumps extending into an interior of the device to facilitate retention of a golf ball, and the bumps are positioned adjacent to the second tube opening of the tube formed when the force is applied to the attached side edges.

9. The device of claim 1 further comprising a strap extending between the opposite panels, the strap preventing the golf club handle from extending more than a predetermined distance into the tube formed when the force is applied to the attached side edges.

10. A ball retriever for temporary attachment to an extension member, the ball retriever including first and second panels each having opposite side and end edges, and a strap extending between one of the edges of the first panel and one of the edges of the second panel, the first panel overlying the second panel with the opposite side edges of the first panel substantially aligned with the opposite side edges of the second panel, the first and second panels each comprising a resilient material biasing them towards a generally flat configuration, the first and second panels being deflectable by a force applied to the opposite side edges to form a tube having opposite tube openings defined by the opposite end edges of the first and second panels, one of the tube openings being sized for receiving and gripping an extension member with the biased first and second panels, the other tube opening being sized for receiving and gripping a ball to be retrieved with the biased first and second panels, the strap preventing the extension member from extending into the tube more than a predetermined distance.

11. The ball retriever of claim 10 wherein the strap extends between one of the end edges of the first panel and one of the end edges of the second panel.

12. The ball retriever of claim 11 wherein the first panel, the second panel, and the strap are integrally formed from the resilient material.

13. The ball retriever of claim 12 wherein the strap includes an intermediate section having a first fold line formed therein, the intermediate section preventing the extension member from extending into the tube more than the predetermined distance, the strap being attached to one of the end edges of the first panel along a second fold line and to one of the end edges of the second panel along a third fold line.

14. The ball retriever of claim 13 wherein the strap is H-shaped.

15. The ball retriever of claim 10 wherein at least one of the side edges of the first panel is releasably attached to one of the side edges of the second panel.

16. The ball retriever of claim 15 wherein each of the side edges of the first panel are releasably attached to one of the side edges of the second panel.

17. A golf ball retriever formed solely from a generally flexible material and comprising:

a means for temporarily attaching the retriever to a golf club handle and means for grasping a golf ball when the retriever is attached to the golf club handle with the attaching means;

a means for preventing the golf club handle from extending through the retriever more than a predetermined distance when the retriever is attached to the golf club handle with the attaching means;

the attaching means and grasping means together comprise opposite panels, each of the opposite panels having first and second side edges; and means for releasably attaching the first and second side edges of one of the opposite panels with the first and second side edges of the other of the opposite panels, respectively.

18. The retriever of claim 17 wherein the retriever is integrally formed from the generally flexible material.

* * * * *